US009861169B1

(12) United States Patent
Scior et al.

(10) Patent No.: US 9,861,169 B1
(45) Date of Patent: Jan. 9, 2018

(54) CONVERTIBLE FOOD AND BEVERAGE PLACEMAT AND CARRIER

(71) Applicants: Susan D. Scior, Lowell, MA (US); William G. Weber, Valley Village, CA (US)

(72) Inventors: Susan D. Scior, Lowell, MA (US); William G. Weber, Valley Village, CA (US)

( * ) Notice: Subject to any disclaimer, the term of this patent is extended or adjusted under 35 U.S.C. 154(b) by 0 days.

(21) Appl. No.: 15/089,693

(22) Filed: Apr. 4, 2016

Related U.S. Application Data

(63) Continuation of application No. 14/156,938, filed on Jan. 16, 2014, now Pat. No. 9,301,594.

(60) Provisional application No. 61/753,148, filed on Jan. 16, 2013.

(51) Int. Cl.

| | |
|---|---|
| ***B65D 71/00*** | (2006.01) |
| ***A45F 4/00*** | (2006.01) |
| ***A45C 3/04*** | (2006.01) |
| ***A47G 23/03*** | (2006.01) |
| ***A47G 23/02*** | (2006.01) |
| ***B65D 25/28*** | (2006.01) |

(52) U.S. Cl.
CPC ..... *A45C 3/045* (2013.01); *A47G 23/0216* (2013.01); *A47G 23/0303* (2013.01); *B65D 25/2888* (2013.01)

(58) Field of Classification Search
CPC ..... A45F 4/00
USPC ..... 294/87.2, 15, 159, 141, 149, 152, 16, 294/150, 151, 162, 163; 206/150, 151, 206/159, 163
See application file for complete search history.

(56) References Cited

U.S. PATENT DOCUMENTS

| | | | | | |
|---|---|---|---|---|---|
| 2,766,919 | A * | 10/1956 | Randall | A47G 23/06 | 206/562 |
| 2,826,346 | A * | 3/1958 | Randall | A47G 23/06 | 206/563 |
| 3,341,245 | A * | 9/1967 | Wolford | B65D 71/504 | 206/150 |
| 4,557,375 | A * | 12/1985 | Weaver | B65D 71/504 | 206/150 |
| 4,850,479 | A * | 7/1989 | Bird | B65D 71/504 | 206/150 |
| 5,060,999 | A * | 10/1991 | Marvin | B65D 71/504 | 206/150 |
| 5,098,144 | A * | 3/1992 | Marvin | B65D 71/504 | 206/150 |
| 5,267,644 | A * | 12/1993 | Tsao | B65D 71/48 | 206/151 |

(Continued)

*Primary Examiner* — Paul T Chin
(74) *Attorney, Agent, or Firm* — Galgano IP Law PLLC; Thomas M. Galgano; Jessica G. McDonald

(57) ABSTRACT

A convertible placemat and carrier having a generally planar flexible sheet with a center portion for supporting an object, preferably food and beverage products. The carrier also includes a plurality of spaced-apart slits arranged in a plurality of concentric rings extending radially outward from the center portion of the sheet. The remaining portion of the sheet between the slits is interconnected to form a lattice structure. The sheet is moveable from a flat planar configuration to an expanded configuration in the form of a carrier. An object is held in the center of the sheet and handle portions are moveable upwardly away from the center portion and the sheet expands via the lattice structure to form a carrier for holding the object placed in the center portion.

20 Claims, 5 Drawing Sheets

(56) References Cited

U.S. PATENT DOCUMENTS

| | | | | | |
|---|---|---|---|---|---|
| 5,695,052 | A * | 12/1997 | Damato | A47G 19/065 | 206/217 |
| 5,755,474 | A * | 5/1998 | Slomski | B65D 71/504 | 206/150 |
| 6,651,836 | B1 * | 11/2003 | Hofheins | A47G 19/06 | 206/562 |
| 8,096,413 | B2 * | 1/2012 | Coltri De Paula | B65D 71/42 | 206/153 |
| D695,135 | S * | 12/2013 | Macqueen | D9/751 | |
| D740,134 | S * | 10/2015 | Brinda | D9/456 | |
| 9,301,594 | B1 * | 4/2016 | Scior | A45C 9/00 | |
| 2005/0241964 | A1 * | 11/2005 | Taylor | B65D 71/48 | 206/170 |
| 2008/0203204 | A1 * | 8/2008 | Olsen | B65D 71/504 | 242/160.1 |
| 2009/0230083 | A1 * | 9/2009 | Metcalfem | B65D 71/508 | 215/395 |
| 2010/0059392 | A1 * | 3/2010 | Weinberger | B65D 71/30 | 206/151 |
| 2010/0096397 | A1 * | 4/2010 | Weinberger | B65D 71/16 | 220/738 |
| 2012/0312820 | A1 * | 12/2012 | Cadiente | B65D 21/0219 | 220/367.1 |

* cited by examiner

Fig. 1
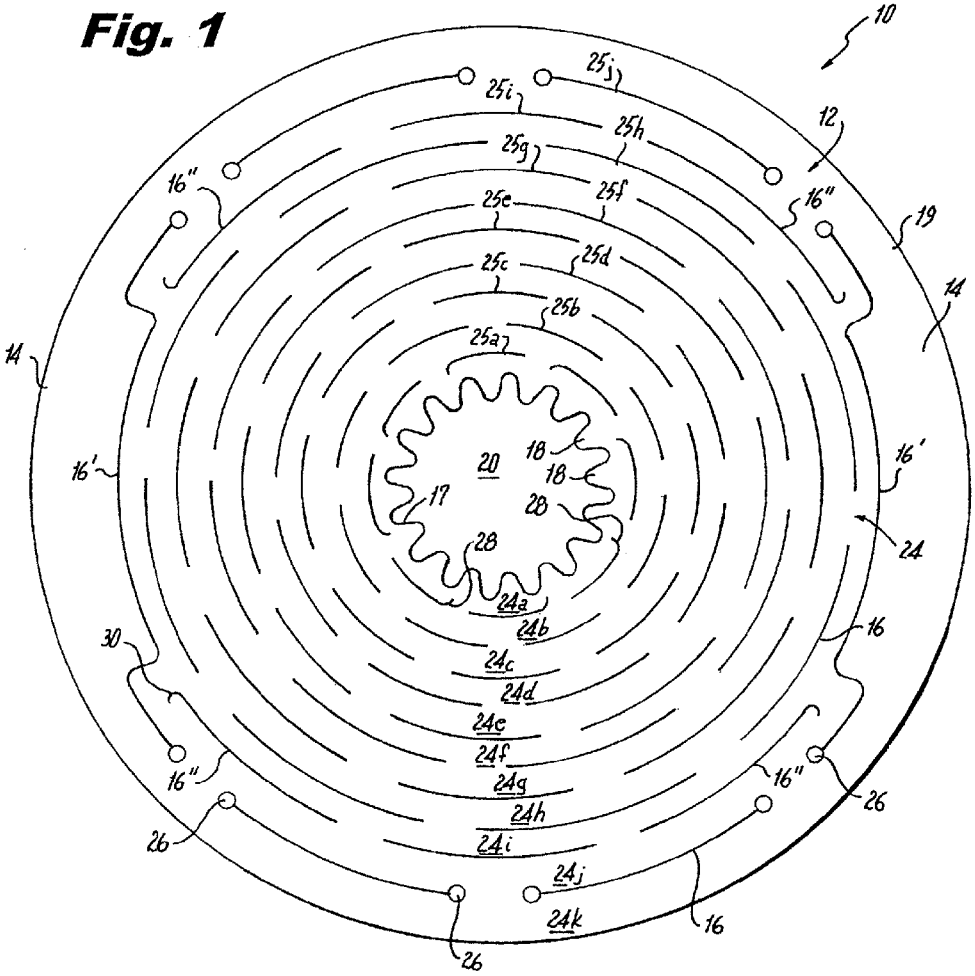
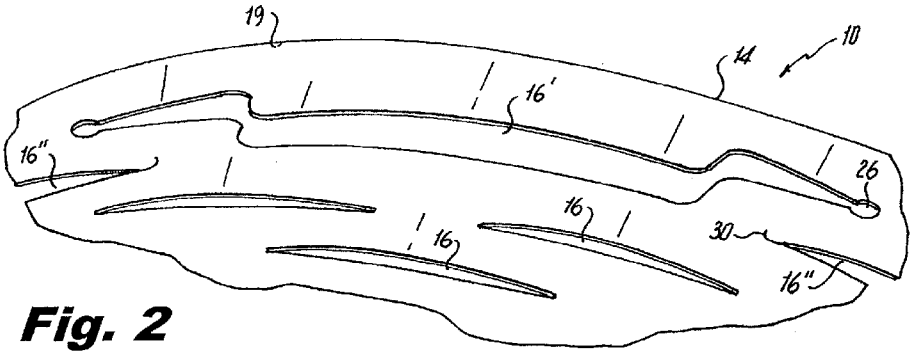
Fig. 2

CONVERTIBLE FOOD AND BEVERAGE PLACEMAT AND CARRIER

CROSS-REFERENCE TO RELATED APPLICATION

This application is a continuation of U.S. application Ser. No. 14/156,938, filed Jan. 16, 2014, which claims benefit from U.S. Provisional Patent Application Ser. No. 61/753,148, filed Jan. 16, 2013, the contents of which are hereby incorporated by reference.

FIELD OF THE INVENTION

The invention relates to a carrier or tote-bag. More particularly, the invention relates to a food and beverage placemat and carrier, which is convertible from a normal, flat configuration, into a bag or tote-like carrier configuration for the transport of food and drinks, and which is capable of thereafter reverting back to its normal, flat configuration, to serve as a placemat, or the like.

BACKGROUND OF THE INVENTION

After ordering food and beverages at a food service establishment, a consumer is typically either provided with means for carrying their food to a table or for take-out. Typically, a patron is provided with either a flat tray with the items placed thereon, a beverage tray fitted with holes for the placement of beverages only therein, with a conventional paper or plastic bag with the items placed therein, or a combination thereof. Neither the flat tray, the beverage tray, nor the bag provide an effective manner of transporting the food and/or beverages, and especially beverages, because the items are piled upon each other and left generally unsecured and unbalanced. Therefore, a consumer is left struggling to carry and balance the food and/or beverages on their own, or to make multiple trips, often times spilling these items or otherwise resulting in general inconvenience. In addition, conventional bags and beverage trays do not offer a flat and protected surface for eating thereon, presenting further problems for a consumer who wishes to eat at the food service establishment.

It is therefore, desirable, to provide means to more easily and effectively transport food and beverage items. It is also advantageous to provide means for carrying food and/or beverages which is convertible into a placemat for providing a surface to eat on.

While the prior art discloses many different means and apparatus for carrying foods and/or beverages, so far as is known, none of the prior art assemblies resolve these problems in a simple, effective and highly advantageous manner, as in the present invention.

SUMMARY OF THE INVENTION

It is therefore an object of the present invention to provide a novel convertible food and beverage placemat and carrier.

It is also an object of the present invention to provide a convertible food and beverage placemat and carrier which overcomes the problems discussed above.

It is a further object of the present invention to provide a convertible food and beverage placemat and carrier having a first or normal, flat configuration, which can serve as a placemat.

It is another object of the present invention to provide a convertible food and beverage placemat and carrier which is convertible into a bag or tote-like carrier configuration and which can revert back to its normal, flat configuration.

It is yet another object of the present invention to provide a convertible food and beverage placemat and carrier which is more effective at carrying foods and beverages than the prior art devices.

It is a further object of the present invention to provide a convertible food and beverage placemat and carrier which is simpler and easier to use than the prior art assemblies.

Certain of the foregoing and related objects are readily attained according to the present invention by the provision of a convertible carrier, comprising a generally planar flexible sheet having a center portion for supporting at least one object; a plurality of spaced-apart slits defined in said sheet and arranged in a plurality of concentric rings extending radially outward from said center portion, and wherein the remaining portion of said sheet between said plurality of slits is interconnected to form a lattice structure; and handle means on said sheet; wherein said sheet is moveable from its first normal, planar configuration to a second, expanded configuration in the form of a carrier, wherein an object is held in said center portion of said sheet and said handle means are moveable upwardly away from said center portion of said sheet, and said sheet expands via said lattice structure defined by said plurality of slits to form a carrier for holding the object placed in the center portion thereof.

In a preferred embodiment, said sheet has a shape which is a member selected from the group consisting of generally circular-shaped and generally rectangular-shaped. Desirably, said sheet has at least one generally centrally disposed opening defined in said center portion thereof and said concentric rings are disposed around and extend radially outward from said at least one opening. It is preferred that said sheet has an outer peripheral edge and an inner peripheral edge, wherein said inner peripheral edge is undulating to form a plurality of fingers for grasping an object placed therein.

In another embodiment, said center portion comprises at least one generally propeller-shaped cutout formed by a plurality of generally C-shaped slits defined in said sheet and a plurality of concentric rings of slits are disposed around and extend radially outward from said at least one generally propeller-shaped cutout. Preferably, two generally propeller-shaped cutouts are formed in said center portion of said sheet each having a plurality of concentric rings of slits disposed around and extending radially outward from said propeller-shaped cutout.

Advantageously, said slits in each concentric ring are offset relative to said slits in the adjacent concentric rings. Preferably, said plurality of slits are evenly spaced-apart from each other within each of said concentric rings. It is also preferred that said plurality of concentric rings are evenly spaced apart from each other.

It is desirable that said handle means are openings defined in said sheet outwardly of the outermost concentric ring of slits. Alternatively, said handle means are slits formed in said sheet outwardly of the outermost concentric ring of slits. In another alternative embodiment, said handle means are slits defined in the outermost concentric ring.

It is preferable that said slits are spaced approximately 5/16" apart. Advantageously, said slits formed in the innermost concentric ring each have an end portion which curves inwardly towards said center portion of said sheet. It is also advantageous that said slits formed in the outermost concentric ring have an end portion which curves outwardly away from said center portion of said sheet. Desirably, said handle means comprise slits defined in said sheet having a circular-shaped cutout on each end thereof. Preferably, at least one of said slits has a circular-shaped cut-out on at least one of its ends.

In one preferred embodiment, said concentric rings of slits are generally circular shaped. In another preferred embodiment, said concentric rings of slits are generally rectangularly shaped. Advantageously, in said first, normal planar configuration said sheet is in the form of a placemat. Desirably, said sheet is imprinted with indicia. It is also preferred that said carrier is configured and dimensioned for carrying at least one beverage and said center portion is configured and dimensioned to receive and support at least one beverage placed therein. Desirably, said handle means are interlocking handles.

Certain of the foregoing and related objects are also readily attained according to the present invention by the provision of a method of carrying an object in a convertible carrier, comprising the steps of providing a convertible carrier, comprising a generally planar flexible sheet having a center portion for supporting at least one object; a plurality of spaced-apart slits defined in said sheet and arranged in a plurality of concentric rings extending radially outward from said center portion, and wherein the remaining portion of said sheet between said plurality of slits is interconnected to form a lattice structure; and handle means on said sheet; wherein said sheet is moveable from its first normal, planar configuration to a second, expanded configuration in the form of a carrier, wherein an object is held in said center portion of said sheet and said handle means are moveable upwardly away from said center portion of said sheet, and said sheet expands via said lattice structure defined by said plurality of slits to form a carrier for holding the object placed in the center portion thereof; placing an object in the center portion of said sheet when said sheet is in its first normal, planar configuration; and moving said handle means upwardly away from said center portion of said sheet, such that said sheet expands via said lattice structure defined by said plurality of slits, into said second, expanded configuration in the form of a carrier for holding the object placed in the center portion thereof. Preferably, the method further comprises the step of providing at least one beverage and wherein said object placed in the center portion of said sheet is said at least one beverage.

BRIEF DESCRIPTION OF THE DRAWINGS

The preferred embodiments of the present invention will now be more particularly described by way of example with reference to the accompanying drawings. Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

FIG. 1 is a top plan view of a circular-shaped convertible food and beverage placemat and carrier embodying the present invention, in its normal, flat configuration;

FIG. 2 is an enlarged, fragmentally-illustrated perspective view of an outer portion of the food and beverage placemat and carrier of FIG. 1, having a slit which defines a handle;

DETAILED DESCRIPTION OF THE PREFERRED EMBODIMENTS

Figure 3:
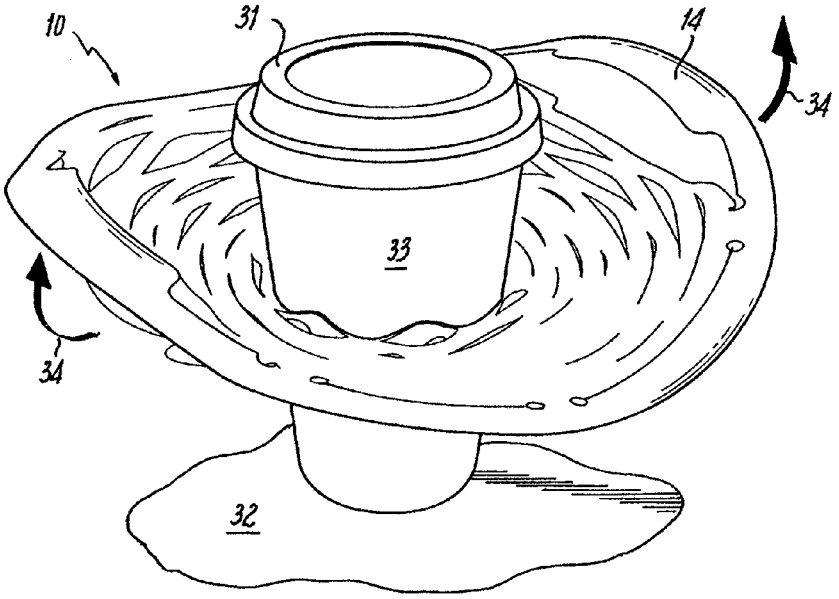
FIG. 3 is a perspective view of the circular-shaped food and beverage placemat and carrier shown in use and being initially raised up around a beverage cup as it is moved into its carrier configuration.
Figure 4:
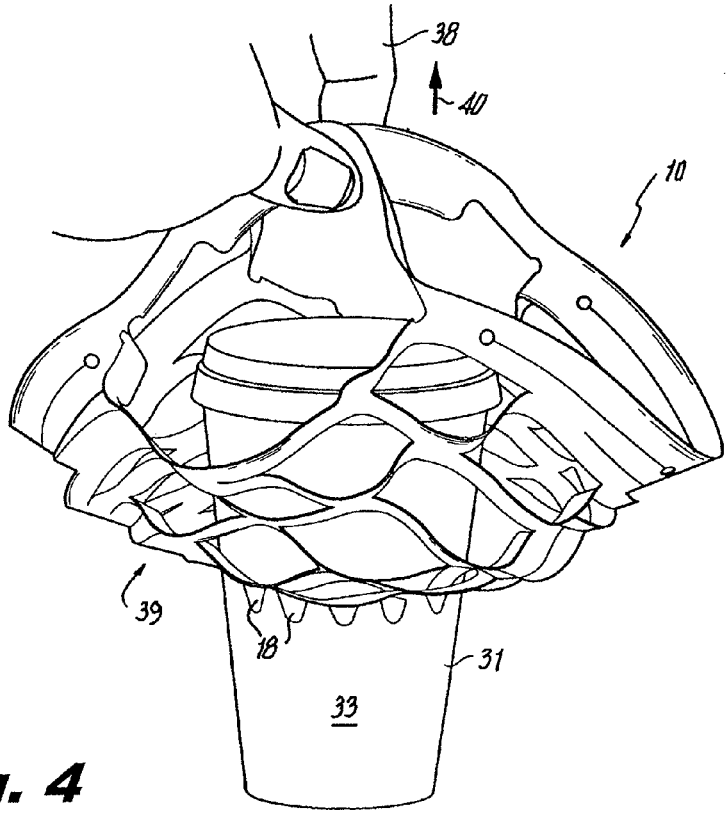
FIG. 4 is a perspective view of the circular-shaped food and beverage placement and carrier comparable to that of FIG. 3, but showing it in its fully expanded, tote-like carrier configuration.
Figure 5:
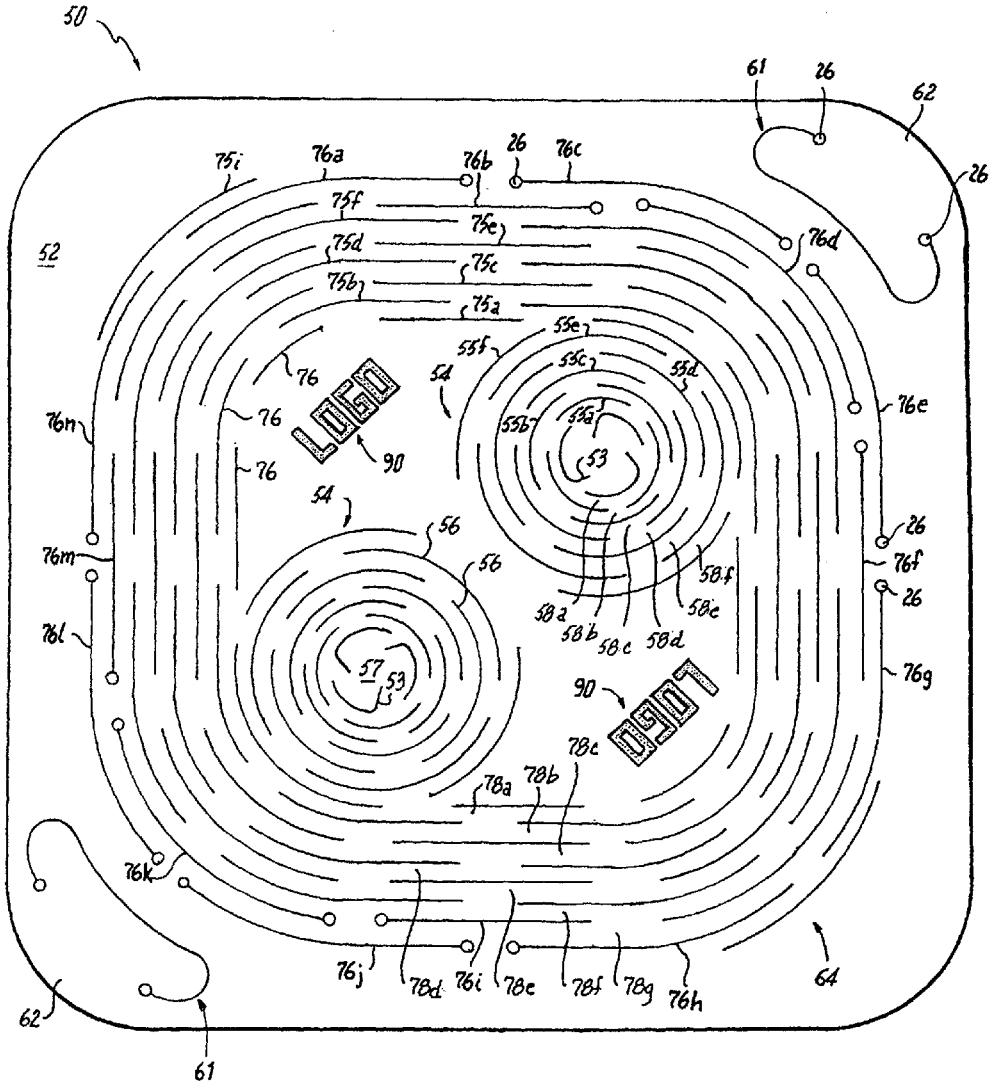
FIG. 5 is a top plan view of a square-shaped food and beverage placemat and carrier embodying the present invention, in its normal, flat configuration and imprinted with indicia.
Figure 6:
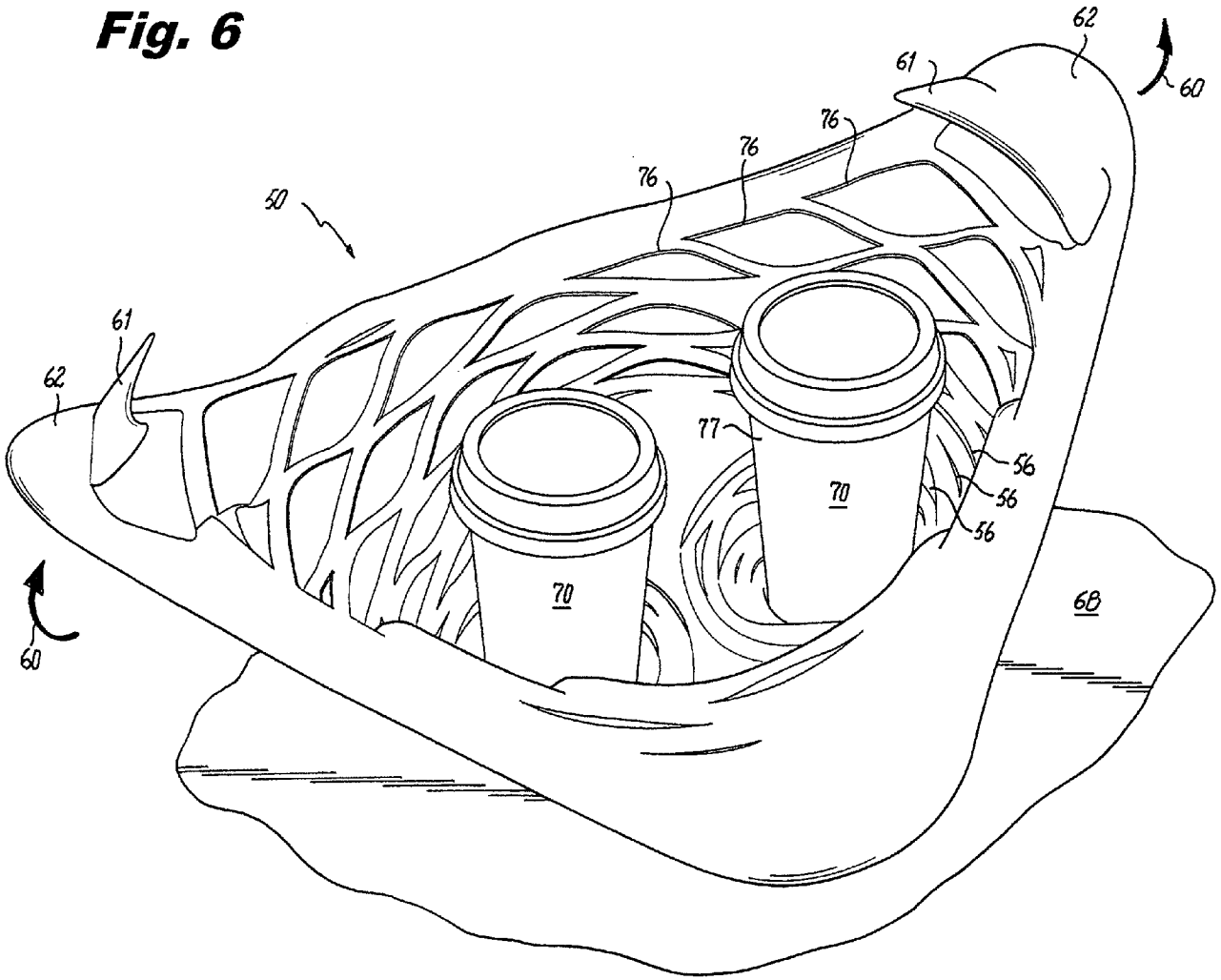
FIG. 6 is a perspective view of the square-shaped food and beverage placemat and carrier of FIG. 5, shown in use and being raised up around two beverage cups, as it is moved into its carrier configuration.
Figure 7:
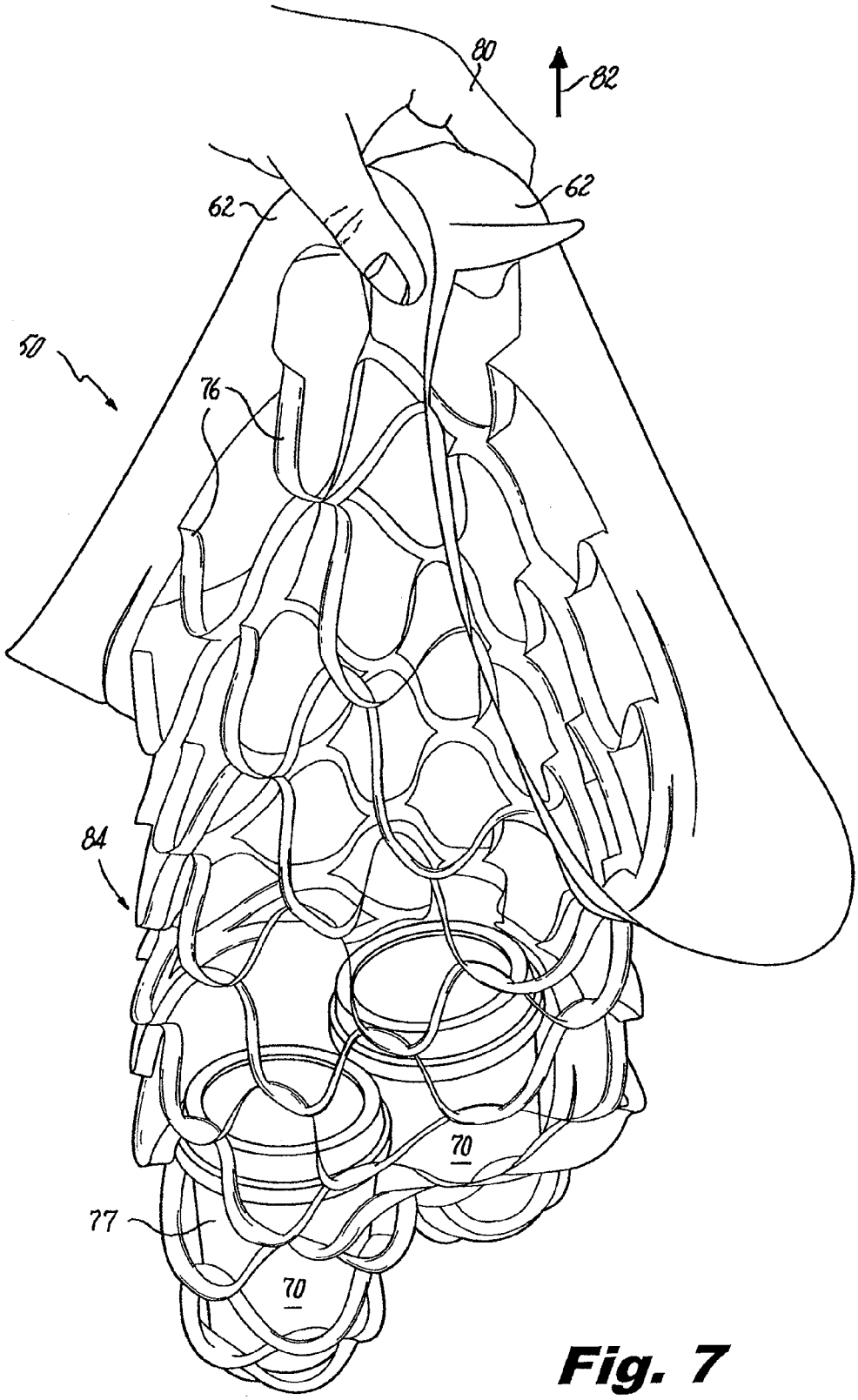
FIG. 7 is a perspective view of the square-shaped food and beverage placemat and carrier shown in use holding two beverage cups in its fully expanded, tote-like carrier configuration.

Referring now in detail to the drawings, therein illustrated are two preferred embodiments of the convertible food and beverage placemat and carrier according to the present invention, namely a circular-shaped embodiment illustrated in FIGS. 1-4 and a square-shaped embodiment illustrated in FIGS. 5-7.

More particularly, referring to FIG. 1, therein illustrated is a circular-shaped embodiment of the convertible carrier according to the present invention, generally designated by reference numeral 10, which is particularly suitable for carrying food and beverage products. However, it can be appreciated that the present invention can be adapted to hold any number and type of objects, as desired by a user. In the preferred embodiment of the present invention which is utilized for carrying food and beverage products, the carrier 10 is convertible from a placemat into a carrier, and can convert back into a placemat.

As seen in FIG. 1, carrier 10 comprises a thin, planar and generally flexible sheet of material 12. In the embodiment illustrated in FIGS. 1-4, the sheet 12 is generally circular-shaped and, in an alternative embodiment illustrated in FIGS. 5-7, the sheet is generally rectangularly-shaped. However, it can be appreciated that the sheet can be formed in other shapes and sizes, as desired.

In the embodiment illustrated in FIG. 1, carrier 10 has a central portion for supporting at least one object therein, such as a beverage 31. Particularly, carrier 10 includes a generally circular-shaped aperture or opening 20 defined in the sheet 12. More particularly, the sheet 12 has an inner peripheral edge 17 and an outer peripheral edge 19. Opening 20 is defined by inner edge 17. Preferably, inner edge 17 is undulating or wavy to form a plurality of outwardly extending tabs or fingers 18 which serve to better grasp and hold an object, such as a beverage cup 31 or the like which is inserted into opening 20.

As seen in FIG. 1, carrier 10 also includes a plurality of spaced-apart slits 16 defined in the sheet 12 and arranged in the form of a plurality of concentric rings 25*a-j* of slits 16, which extend radially outward from the central opening 20. In the embodiment illustrated in FIG. 1, the concentric rings 25*a-j* of slits 16 are generally circular-shaped and encircle and surround central opening 20, and extend radially outwardly therefrom to the outer peripheral edge 19. Furthermore, the remaining portion of sheet 12 between the concentric rings 25*a-j* of slits 16 as well as between the slits 16, is interconnected to define concentric interconnected rings 24*a-k*, which also extend radially outwardly from the inner edge 17 to the outer edge 19, in a generally concentric ring-shaped pattern.

It is preferred that the slits 16 in each of the rings 25*a-j* are offset or staggered relative to the slits 16 in the adjacent rings, to define an alternating slit pattern and an overall lattice-like structure. It is also preferable that the slits 16 are evenly spaced-apart from each other within each of the concentric rings 25*a-j* and that the concentric rings 25*a-j* are also evenly spaced apart from each other. Additionally, it is preferred that each of the slits 16 are evenly offset relative to the slits 16 in the adjacent concentric ring of slits. Consequently, concentric rings 24*a-j* of the interconnected portions of sheet 12 are separated from one another, in part, by evenly spaced apart cuts or slits 16, but remain interconnected by their uncut portions, generally forming the body of carrier 10.

As shown in FIG. 1, preferably, the carrier 10 has nine concentric circles or rings 25*a-j* of slits 16 defining ten interconnected concentric rings 24*a-k* with slits 16 preferably spaced 5/16 of an inch apart and offset via alternating locations of slits 16 from the adjacent concentric rings 25*a-j*, thus enabling carrier 10 to form a lattice-like structure when in its tote-like carrier configuration (FIGS. 3-4). Preferably, concentric rings 25*a-h* have eight slits 16, while the two outermost concentric rings 25*i* and 25*j* each have six slits 16.

As shown more particularly in FIG. 1, slits 16 on the innermost concentric ring 25*a* each have one end portion 28 that curves inwardly, toward central aperture 20. Slits 16' on the outermost concentric ring each have an end portion formed by small circular-shaped cutouts 26, as seen in FIG. 2. Two corresponding pairs of slits 16' on outermost levels 25*i* and 25*j* are located on opposing ends of the carrier 10, and have ends which after initially following the generally concentric pattern on ring 25*j* curve inwardly via a generally ninety degree turn, toward the central aperture 20, preferably for 5/16 of an inch, and have a second generally 90 degree turn toward each other, joining the concentric pattern of ring 25*i* until they meet. Thus slits 16' define two handle portions 14 on sheet 12. Two corresponding pairs of slits 16" on second outermost concentric ring 25*i* are located on opposing ends of the carrier 10. Each of slits 16" have a curved inner end portion 30 which hooks outwardly and away from the central aperture 20. The curved end portion 30 is disposed generally adjacent to the curve in slits 16' on the second outermost level 25*i*.

Carrier 10 is convertible and moveable from its first normal, planar configuration, as seen in FIG. 1, to a second, fully expanded configuration in the form of a carrier or tote, as shown in FIG. 4. In the second configuration illustrated in FIGS. 3-4, carrier 10 expands via the net-like or lattice-like structure formed by the plurality of concentric rings 25*a-j* of slits 16 and concentric interconnected rings 24*a-k*, to form a carrier or tote-like bag for holding objects placed in the center portion thereof.

As seen in FIGS. 1 and 2, handle means 14 are also provided to allow a user to grasp and hold the carrier 10. Particularly, two generally rectangularly-shaped handle regions 14 are located adjacent to opposing sides of the outer edge 19 of the carrier 10 and are defined by slits 16'. As more particularly shown in FIG. 2, when the carrier 10 is raised off of a flat surface (not shown) and begins to move into its tote-like carrier configuration (FIGS. 3-4), the slits 16' on the outermost concentric ring 25*j* expand, as the handles 14 are grasped by the user and are raised up and away from the remaining body of carrier 10. Also, as it can be appreciated from FIG. 2, curved ends 30 of slits 16" in concentric ring 25*i* provide additional support and flexibility for handle regions 14 which aid in the carrying of beverage and food items placed therein.

As depicted in FIG. 3, central aperture 20 is sized and dimensioned for receipt and securement of at least a portion of an object therein, here a beverage cup 31 having generally tapered sides 33. As it can be appreciated, when carrier 10 is in its normal, flat configuration (FIG. 1) and resting on a flat surface 32, a beverage cup 31 is capable of being placed within the central aperture 20, with the bottom of the beverage cup 31 resting on the flat surface 32. As shown in FIG. 3, carrier 10 is capable of moving from its normal, flat configuration (FIG. 1) to a partially transitioned configuration, as carrier 10 is raised up off the flat surface 32 via handles 14. Particularly, handles 14 are raised and moveable in an upward direction (arrow 34) away from the center portion of the sheet. The upward motion (arrow 34) allows concentric rings 25*a-j* of slits 16 and, thus, interconnected concentric rings 24*a-j*, to expand into a partial, lattice-like structure under the weight of the beverage cup 31 via conventional gravity forces. The central aperture 20, and in turn, fingers 18 slide up tapered sides 33 of beverage cup 31 until a generally secure fit is attained. As it can be appreciated, when in the partially transitioned, tote-like carrier configuration (FIG. 3), various other goods, including food, napkins, utensils, or the like can be placed on top of or next to beverage cup 31 and within carrier 10.

As shown in FIG. 4, carrier 10 is capable of moving from its partially transitioned configuration (FIG. 3), to a fully transitioned tote-like carrier configuration, as a user draws the two handles 14 upwardly and inwardly until they meet and are held between a user's fingers 38. Carrier 10 and, in turn, beverage cup 31 are lifted in an upward direction (arrow 40) off of the flat surface 32 to secure the items. The upward motion (arrow 40) allows concentric rings 25*a-j* of slits 16 and, thus, interconnected concentric rings 24*a-k* to expand completely open via conventional gravity forces, forming a full net-like, mesh-like, or lattice-like structure 39 while the tabs or fingers 18 of the central aperture 20 securely hold the tapered sides 33 of beverage cup 31 in an upright position and enable the beverage cup 31 to be carried safely by the user. As it can be appreciated, when in the fully transitioned, tote-like carrier configuration, carrier 10 can also hold various other goods, including food, napkins, utensils or the like. It can also be appreciated that once a user returns carrier 10 onto a flat surface 32, the carrier 10 is capable of reverting to its normal, flat configuration (FIG. 1). In the normal and planar configuration, the carrier 10 can serve as a placemat or the like.

Turning now to the second embodiment of the present invention illustrated in FIGS. 5-7, therein illustrated is a square-shaped embodiment of the convertible food and beverage placemat and carrier, generally designated by reference numeral 50. As illustrated in FIG. 5, carrier 50 comprises a thin, planar and generally square-shaped sheet of flexible material 52. However, it can be appreciated that carriers 10 and 50 can assume different sized and shaped configurations depending on the desired needs of the carrier. In the preferred embodiment, carrier 50 is 16"×16". However, it can be appreciated that other suitable dimensions can be utilized.

Carrier 50 includes a central portion having a plurality of slits 56 arranged in two generally centrally disposed circular-shaped concentric ring-shaped patterns 54. Ring-shaped patterns 54 are formed by a plurality of slits 56 which are formed in sheet 52 and arranged in concentric circles or rings 55*a-f* extending radially outwardly. Preferably, slits 56 are evenly spaced from each other and offset from the slits in the adjacent concentric rings. Preferably, slits 56 are spaced apart 5/16". The remaining portions of carrier 50 are interconnected between the slits 56, to define a plurality of interconnected concentric rings 58*a-f*, within the ring-shaped patterns 54.

Two generally propeller-shaped cutouts 57 are defined generally in the center of the plurality of rings 58*a-f* in the ring-shaped patterns 54. The propeller-shaped cutouts are defined by three generally C-shaped slits 53 defined in sheet 52. The rings 58*a-f* are separated from one another in part by slits 56, but are otherwise interconnected by their uncut portions, generally forming the body of carrier 50. As shown in FIG. 5, preferably, the generally circular concentric ring-shaped patterns 54 are each provided with six concentric rings 55*a-f* of slits 56, defining six interconnected concentric rings 58*a-f*, not including the central propeller-shaped cut-out 57. Advantageously, concentric rings 55*a-f* each have three slits 56, which are preferably spaced 5/16 of an inch apart and offset or staggered from the slits 56 in the adjacent concentric ring.

As depicted in FIG. 5, the two generally concentric ring-shaped patterns 54 are surrounded by a single generally square-shaped concentric ring-shaped pattern 64 of evenly spaced and staggered cuts or slits 76 which define rectangularly-shaped concentric rings 78*a-h* of slits 76. The generally rectangular concentric ring-shaped pattern 64 is preferably provided with nine concentric rings 75*a-i* of cuts or slits 76, defining eight interconnected concentric rings 78*a-h*. Preferably, the innermost concentric ring 75*a* is provided with six slits 76, the outermost concentric ring 75*i* is provided with four slits 76, while the remaining concentric rings 75*b-h* are provided with eight slits 76. It is also preferred that the slits are spaced 5/16" apart. However, it can be appreciated that the number, size, and spacing of the slits and concentric rings can be modified.

As also depicted in FIG. 5, in the preferred embodiment certain slits 76 are provided with circular-shaped cutouts 26 on the ends thereof to reduce stresses and prevent tearing. As seen in FIG. 5, slits labeled as 76*a*-76*n* have circular-shaped cutouts 26 on at least one of the ends thereof.

Handle means 62 are provided on opposite corners of carrier 50 and disposed outwardly of the outermost concentric ring of slits 75*i*. The handle means are two generally oval-shaped cutouts 61 generally following the contours of the concentric rings 75*a-i* on two sides thereof. Handles 61 are disposed diagonally of each other on carrier 50. However, it can be appreciated that other shapes can be utilized such as generally trapeziodally-shaped. Cutouts 61 can be fully cut-out from sheet 52 or remain interconnected on an edge thereof to form a flap, as seen best in FIG. 6. It can be appreciated that the handles can assume other shapes and orientations. In the preferred embodiment, handles 61 are interlocking as a result of the corresponding openings and flaps to more easily maintain the carrier 50 in its expanded configuration and held by the user. Handles 61 interlock via one of the handles 61 being received within the other handle opening. It is also preferable that the slits forming handles 61 have circular-shaped cutouts 26 on the ends thereof, as seen in FIG. 5, to relieve stresses on carrier 50 and prevent tearing.

As depicted in FIG. 6, generally circular-shaped concentric ring patterns 54 are each sized and dimensioned for receipt of an object therein, here beverage cups 70 which have generally tapered sides 77. As it can be appreciated, when carrier 50 is in its normal, flat configuration (FIG. 5) resting on a flat surface 68, beverage cups 70 are capable of being placed on each of the propeller-shaped cutouts 57, with the bottom of beverage cups 70 also generally supported by the flat surface 68.

As shown in FIG. 6, carrier 50 is capable of moving from its normal, flat configuration (FIG. 5) to a partially transitioned configuration, as carrier 50 is raised up off the flat surface 68 via handles 62 being raised in an upward direction (arrows 60). The upward motion (arrow 60) allows concentric rings 55*a-f* and 75*a-i* of slits 56 and 76, respectively, and thus interconnected rings 58*a-f* and 78*a-h* of each respective concentric ring pattern 54 and 64 to begin to expand open under the weight of beverage cups 70 via conventional gravity forces, with the bottom and tapered sides 77 of beverage cups 70 supported as the rings transition to a net-like or lattice-like structure 84. As can be appreciated, when in the partially transitioned configuration, various other goods, including food, napkins, utensils or the like can be placed generally within carrier 50.

As depicted in FIG. 7, carrier 50 is capable of moving from its partially transitioned configuration (FIG. 6), to a fully transitioned tote-like carrier configuration, as a user draws the two handles 62 inwardly and upwardly until they meet and are held between a user's fingers 80, as carrier 50 and beverage cups 70 are lifted in an upward direction (arrow 82) completely off of flat surface 32. The upward motion (arrow 82) allows the slits 56 and 76 to expand completely open under the weight of beverages 70 via conventional gravity forces, forming net-like or lattice structure 84 securely supporting beverage containers 70 in an upright position and enabling them to be carried safely by the user. As it can be appreciated, when in the fully transitioned, tote-like configuration, carrier 50 can hold various other goods, including food, napkins, utensils or the like. It can also be appreciated that once a user returns carrier 50 onto a flat surface, it is capable of reverting to its normal, flat configuration (FIG. 5), and can serve as a placemat or the like.

As can be seen in FIG. 5, carrier 50 is imprinted with indicia 90, such as words, graphics, logos, photographs, advertising material and the like such as of sports figures, cartoons, business names, or other commercial entities for promotional services. Indicia 90 can be imprinted on the entire surface of carriers 10 and 50 or a portion thereof. Furthermore, either side of the carrier 50 can be imprinted with indicia 90.

The carriers 10 and 50 of the present invention are particularly suitable for use in fast food establishments, or like establishments. When food and beverages are sold at fast food establishments, they are placed in the center portion of the carriers 10 and 50, preferably with the beverage cups 33 and 70 disposed within the respective opening 20 in the embodiment in FIGS. 1-4 or overlying the propeller-shaped cutout 57, in the embodiment in FIGS. 5-7. Food is then placed on top of the beverages, when served to a customer. The placemat and carrier 10 or 50 is thereafter lifted off of the counter, or flat surface by the customer, as the beverage cups 33 and 70, respectively, remain in an upright position with the food atop the cups, for transport to a table or out of the establishment, as shown in FIGS. 4 and 6-7. The food and beverage carrier is also designed to be bicycle and stroller friendly, e.g., the handles 14 and 62 of the carriers 10 and 50, respectively, may be hooked over the handlebars of a bicycle or stroller, so that when food and/or beverage(s) are taken out of a food establishment or "to go", the rider or walker can transport the food and beverage cup(s) safely while keeping their hands on the handle bars. It can be appreciated that, as shown in FIG. 5, following its utilization as a placemat and carrier, the apparatus can optionally be used as a collectible poster because of the graphics or indicia 90 printed thereon.

The food and beverage carrier is preferably constructed from plastic which has both strong, flexible, durable, and reusable qualities, such as POLYLITH synthetic papers made by Granwell Products, Inc., West Caldwell, N.J. However, other suitable materials which are strong and flexible may used as well, for example, POLYART made by Arjobex America of Charlotte, N.C., YUPO synthetic paper made by YUPO Corporation America of Chesapeake, Va., tear resistant felt, paperboard treated with VALERON film made by Valeron Strength Films, an ITW Company of Houston, Tex., or TYVEK made by DuPont of Wilmington, Del. A combination of these materials or other materials can also be utilized.

The size, number, and placement of the cuts or slits, as well as the shape, number, and configuration of the general concentric patterns may be altered to hold food or beverage cups of varying sizes and quantities, as well as varying amounts of other items. The carriers themselves may form a number of different shapes or sizes depending on the particular needs. The carriers may have a single or multiple openings or propeller-shaped cutouts formed therein for holding the beverages. The entire surface both inside and out is visible and printable for decorative, branding, or marketing, thus, the carrier can have text or pictorial representations printed thereon, as desired by the customers, which can thereafter serve as a collectible poster or the like. However, the carrier can also be made to be disposable after use. Furthermore, while the present invention is particularly suitable for holding food and beverage products, it can be appreciated that the invention can be used to hold many different types of products.

Additional objects and advantages of the invention will become apparent to those skilled in the art upon reference to the detailed description taken in conjunction with the provided figures.

The invention claimed is:

1. A convertible carrier, comprising:

a generally planar flexible sheet having a center portion for supporting at least one object wherein said sheet has an outer peripheral edge and an inner peripheral edge, wherein said inner peripheral edge defines a single central opening therebetween and is undulating to form a plurality of fingers for grasping an object placed therein;

a plurality of spaced-apart slits each defined in said sheet between two opposing lateral edges, said slits being arranged in a plurality of concentric rings encircling said central opening defined in said sheet and extending radially outward from said central opening defined in said sheet, and wherein the remaining portion of said sheet between said plurality of slits is interconnected to form a lattice structure; and handle means on said sheet;

wherein said sheet is moveable from its first normal, planar configuration, to a second, expanded configuration in the form of a carrier, wherein in said first configuration, said lateral edges of said slits contact each other to form a substantially continuous upper surface of said sheet between said inner and outer peripheral edges and wherein an object is held in said center portion of said sheet and said handle means are moveable upwardly away from said center portion of said sheet, and said sheet expands via said lattice structure defined by said plurality of slits to form a carrier for holding the object placed in the center portion thereof.

2. The carrier according to claim 1, wherein:

said sheet has a shape which is a member selected from the group consisting of generally circular-shaped and generally rectangular-shaped.

3. The carrier according to claim 1, wherein:

said sheet has at least one generally centrally disposed opening defined in said center portion thereof and said concentric rings are disposed around and extend radially outward from said at least one opening.

4. The carrier according to claim 1, wherein:

said slits in each concentric ring are offset relative to said slits in the adjacent concentric rings.

5. The carrier according to claim 1, wherein:

said plurality of slits are evenly spaced-apart from each other within each of said concentric rings.

6. The carrier according to claim 1, wherein:

said plurality of concentric rings are evenly spaced apart from each other.

7. The carrier according to claim 1, wherein:

said handle means are openings defined in said sheet outwardly of the outermost concentric ring of slits.

8. The carrier according to claim 1, wherein:

said handle means are slits formed in said sheet outwardly of the outermost concentric ring of slits.

9. The carrier according to claim 1, wherein:

said handle means are slits defined in the outermost concentric ring.

10. The carrier according to claim 1, wherein:

said slits are spaced approximately 5/16" apart.

11. The carrier according to claim 1, wherein:

said slits formed in the innermost concentric ring each have an end portion which curves inwardly towards said center portion of said sheet.

12. The carrier according to claim 1, wherein:

said slits formed in the outermost concentric ring have an end portion which curves outwardly away from said center portion of said sheet.

13. The carrier according to claim 1, wherein:

said handle means comprise slits defined in said sheet having a circular-shaped cutout on each end thereof.

14. The carrier according to claim 1, wherein:

at least one of said slits has a circular-shaped cut-out on at least one of its ends.

15. The carrier according to claim 1, wherein:

said concentric rings of slits are generally circular shaped.

16. The carrier according to claim 1, wherein:

in said first, normal planar configuration said sheet is in the form of a placemat.

17. The carrier according to claim 1, wherein:

substantially all of said upper surface of said sheet is imprinted with indicia to, form a unitary image across substantially all of said upper surface of said sheet, when said carrier is in said first configuration.

18. The carrier according to claim 1, wherein:

said carrier is configured and dimensioned for carrying at least one beverage and said center portion is configured and dimensioned to receive and support at least one beverage placed therein.

19. A method of carrying an object in a convertible carrier, comprising the steps of:

providing a convertible carrier, comprising a generally planar flexible sheet having a center portion for supporting at least one object wherein said sheet has an outer peripheral edge and an inner peripheral edge, wherein said inner peripheral edge defines a single central opening therebetween and is undulating to form a plurality of fingers for grasping an object placed therein; a plurality of spaced-apart slits each defined in said sheet between two opposing lateral edges, said slits being arranged in a plurality of concentric rings encircling said central opening defined in said sheet and extending radially outward from said central opening defined in said sheet, and wherein the remaining portion of said sheet between said plurality of slits is interconnected to form a lattice structure; and handle means on said sheet; wherein said sheet is moveable from its first normal, planar configuration to a second, expanded configuration in the form of a carrier, wherein in said first configuration, said lateral edges of said slits contact each other to form a substantially continuous upper surface of said sheet between said inner and outer peripheral edges and wherein an object is held in said center portion of said sheet and said handle means are moveable upwardly away from said center portion of said sheet, and said sheet expands via said lattice structure defined by said plurality of slits to form a carrier for holding the object placed in the center portion thereof;

placing an object in the center portion of said sheet when said sheet is in its first normal, planar configuration; and moving said handle means upwardly away from said center portion of said sheet, such that said sheet expands via said lattice structure defined by said plurality of slits, into said second, expanded configuration in the form of a carrier for holding the object placed in the center portion thereof.

20. The method according to claim 19, further comprising the step of:

providing at least one beverage and wherein said object placed in the center portion of said sheet is said at least one beverage.

* * * * *